US007007688B2

(12) United States Patent
Kao

(10) Patent No.: US 7,007,688 B2
(45) Date of Patent: Mar. 7, 2006

(54) HEAT CONTROL DEVICE OF PORTABLE GAS STOVES

(75) Inventor: Jin-Shong Kao, Taipei (TW)

(73) Assignee: Rekrow Industrial Inc., Tucheug (TW)

( * ) Notice: Subject to any disclaimer, the term of this patent is extended or adjusted under 35 U.S.C. 154(b) by 218 days.

(21) Appl. No.: 10/734,177

(22) Filed: Dec. 15, 2003

(65) Prior Publication Data

US 2005/0126557 A1 Jun. 16, 2005

(51) Int. Cl.
*F24C 3/12* (2006.01)

(52) U.S. Cl. ..... 126/40; 126/39 E; 431/254

(58) Field of Classification Search ..... 126/40, 126/39 E, 39 BA, 39 B, 39 G, 50, 42, 9 R, 126/38; 431/254, 72, 62, 344
See application file for complete search history.

(56) References Cited

U.S. PATENT DOCUMENTS 4,192,284 A * 3/1980 Vache ..... 126/38
5,613,485 A * 3/1997 Covault ..... 126/38
5,992,408 A * 11/1999 Chen ..... 126/43
6,505,620 B1 * 1/2003 Goto ..... 126/40

FOREIGN PATENT DOCUMENTS

EP 1 500 881 A2 * 1/2005
FR 2 346 642 A * 12/1977

* cited by examiner

*Primary Examiner*—Josiah C. Cocks
(74) *Attorney, Agent, or Firm*—Birch, Stewart, Kolasch & Birch, LLP

(57) ABSTRACT

This invention discloses a heat control device of a portable gas stove, comprising a hollow cylindrical button base and a switch button, an installing slot protruded from the top of the inner wall of the button base, a spring disposed in the installing slot, and a pressing member with its rear end being installed in a limit notch at the open end of the button base for mutual engagement. The pressing member is completely latched into the limit notch to ensure a complete shutdown of the gas supply.

7 Claims, 6 Drawing Sheets

HEAT CONTROL DEVICE OF PORTABLE GAS STOVES

FIELD OF THE INVENTION

The present invention generally relates to heat control devices and more particularly to a heat control device for portable gas stoves that shutdown safely without leaking gas.

BACKGROUND OF THE INVENTION

Conventional portable gas stoves generally comprise a nozzle, a nozzle base, a storage tank and a heat controller. Wherein, the heat controller consists of a hollow long handle, a control button, a spring, an adjusting rod, an igniter, and an electronic ignition device. The hollow long handle has at one end, an opening for the hollow cylindrical dial base, and the other end having a coupling base corresponding to the shape of the nozzle base. The open end of the dial base is used to attach a hollow cylindrical control dial. A compressed spring is installed between the dial base and the control dial. The adjusting rod is used to pass through the adjusting hole of the long handle, such that the external screw thread of the adjusting rod is engages with the internal screw thread of the nozzle base, and the other end of the adjusting rod extends from the dial base and couples with the control dial. However, only sliding and not rotational motion is possible between adjusting rod and control dial.

Although conventional portable gas stoves can effectively drive the nozzle to produce a flame, the conventional portable gas stove still has the following shortcomings in its operation and use:

1. The procedure to turn off the control dial of a traditional gas stove depends on the operator's feeling the end position. The so-called "end position" is difficult to confirm and the control dial usually is not shut completely due to careless operation, thus resulting in gas leakage.

2. Even though the gas valve is closed, the control dial of traditional gas stoves can still slide open. With the ignition button located in the same place the design lacks safety.

3. The gas supply must be steady in order to effectively ignite the fire. If the gas supply is too large and the proportion of gas to air is incorrect, it is difficult to ignite a flame. The conventional way of controlling the gas supply relies on experience from the operator's trial and error, which is inefficient.

SUMMARY OF THE INVENTION

The primary objective of the present invention is to overcome the aforementioned shortcomings by completely latching the press button of the switch into the limit notch; thus ensuring the complete shutdown of the gas stove and effectively preventing gas leakage due an incorrectly positioned control button.

Another objective of the present invention is to indicate the appropriate gas flow for ignition by latching a guide into a recess for effective ignition without requiring the users to adjust the gas flow based on their experience or waste time on trial and error.

BRIEF DESCRIPTION OF THE DRAWINGS

FIG. 5 is a cross-sectional diagram demonstrating the movements of a preferred embodiment of this invention.

DETAILED DESCRIPTION OF THE PREFERRED EMBODIMENTS

Other features and advantages of the present invention will become apparent in the following detailed description of the preferred embodiments with reference to the accompanying drawings.

Figure 1:
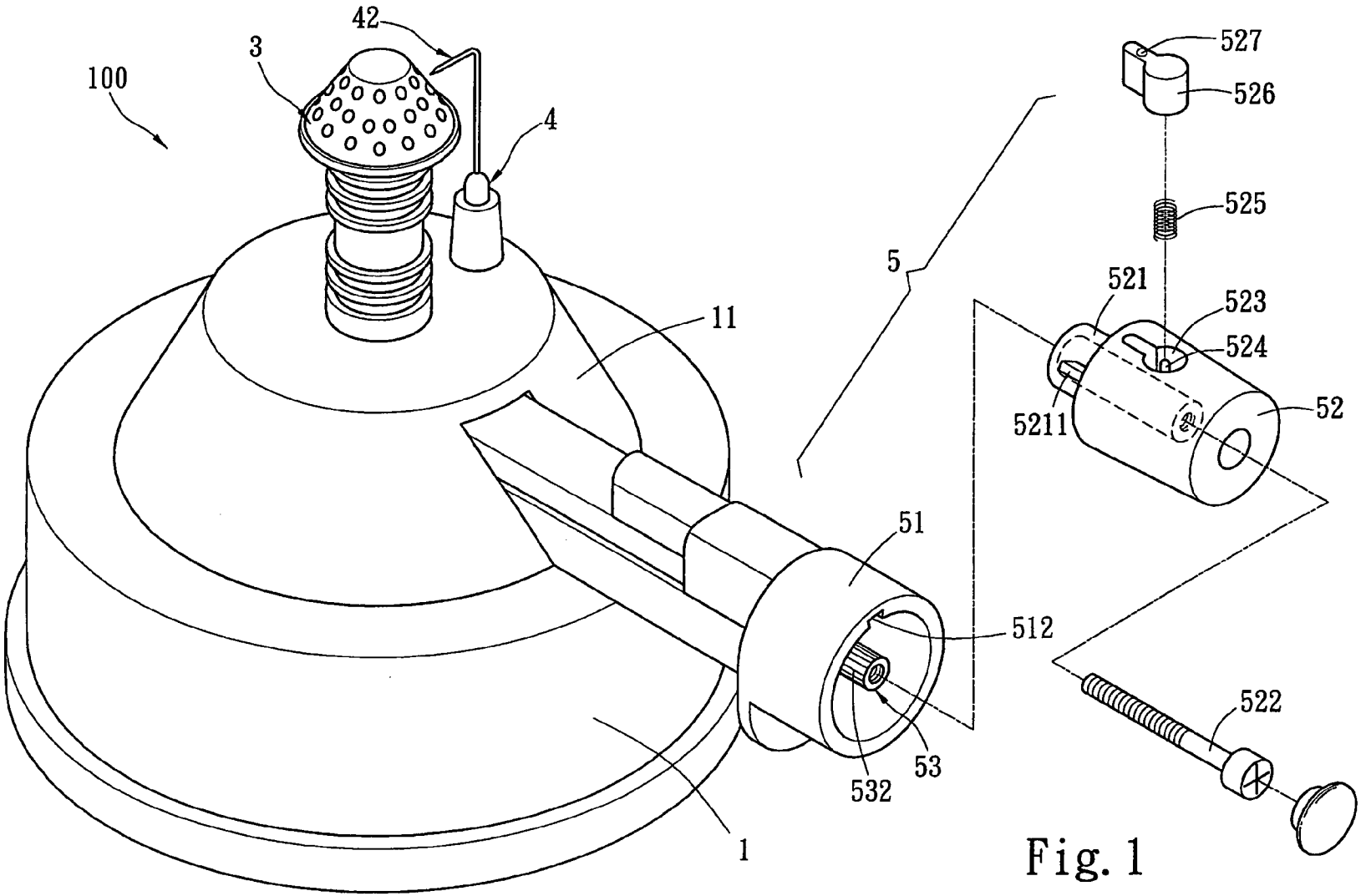
FIG. 1 is a perspective view of the disassembled parts of the switch assembly of this invention.
Figure 2:
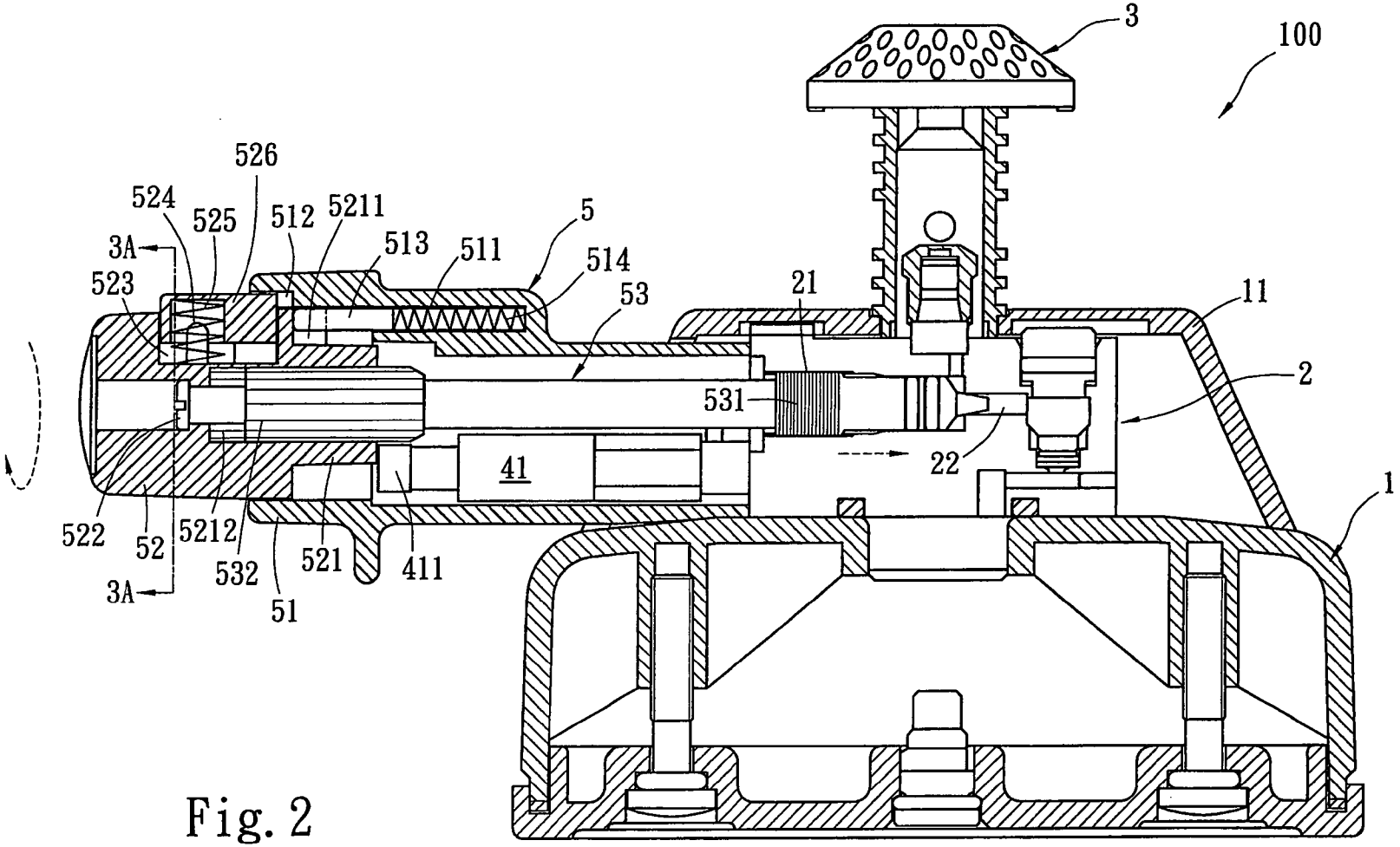
FIG. 2 is a cross-sectional view of the heat control device installed in the gas stove of the present invention.

Please refer to FIGS. 1 and 2 for the perspective view of the disassembled switch assembly and cross-sectional view of the heat controller installed in the gas stove according to this invention. In the figures, a portable gas stove 100 comprises a storage base 1, a nozzle base 2 atop the storage base 1, a nozzle 3, an electronic ignition 4 disposed on the nozzle base 2, and a heat controller 5 disposed on one side of the nozzle base 2.

The heat controller 5 comprises a cylindrical hollow button base 51 with one end coupled to the nozzle base 2 and the other end having an opening to install a push-switch 52, an installation slot 511 protrudes from the top of the inner wall of the button base 51, a spring 514 disposed in the installation slot 511, a pressing axle 513 for pressing against the free end of the spring 514, and a limit notch 512 disposed above the installation slot 511.

An adjusting rod 53 is installed between the push-switch 52 and the nozzle base 2, and the outer screw thread 531 of the adjusting rod 53 is locked onto the inner screw thread 21 of the nozzle base 2. The other end of the adjusting rod 53 extends from the button base 51 and couples to the push-switch 52 by a locking member 522, so that the button base 51 can control the adjusting rod 53 to rotate accordingly, move the push-switch 52 horizontally a predetermined distance and slide the locking member 522 along the axial direction, such that the external thread 532 at one end of the adjusting rod 53 slides with the corresponding internal thread 5212 inside the button base 51.

In FIG. 1, an accommodating groove 523 is disposed on the push-switch 52; a positioning axle 524 is disposed in the accommodating groove 523; a spring 525 is sheathed onto the positioning axle 524; and a pressing member 526 is sheathed into the accommodating groove 523. The rear end of the pressing member 526 is latches into the limit notch 512 at the open end of the button base 51, and a guide 527 is protrudes from the top of the pressing member 526. Further, a support section 521 protrudes from one end extended from the push-switch 52 into the button base 51, and a blocking member 5211 is disposed on the support section 521, such that the displacement of the blocking member 5211 is blocked and limited by the pressing axle 513 in the installation slot 511.

The electronic ignition device 4 comprises an igniter 41 and an electrode 42. The igniter 41 is assembled into the hollow cylindrical button base 51 under the adjusting rod 53 and the pressing section 411 at one end of the igniter 41 extends to the support section 521 of the push-switch 52.

In FIG. 2, after the heat controller 5 of this invention is installed inside a gas stove 100. The force produced by the spring 525 is exerted on the pressing member 526 of the push-switch 52 to instantaneously push the pressing member 526 into the limit notch 512 of the button base 51, such that the pressing member 526 latches into the limit notch 512 to restrict rotation and prevent operation of the push-switch 52.

Figure 3B:
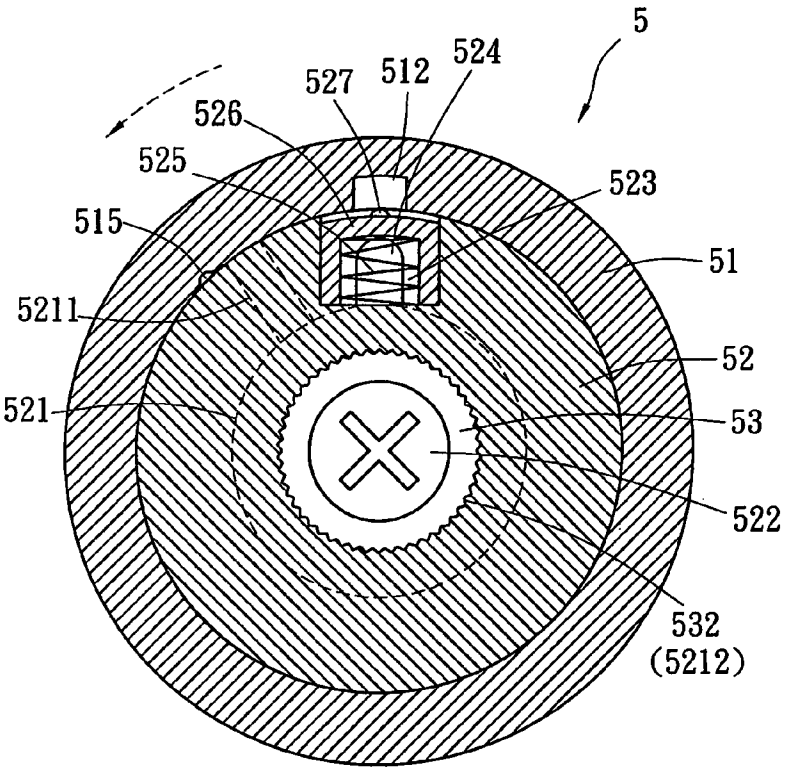
FIG. 3B is a diagram of movements according to FIG. 3A.
Figure 3A:
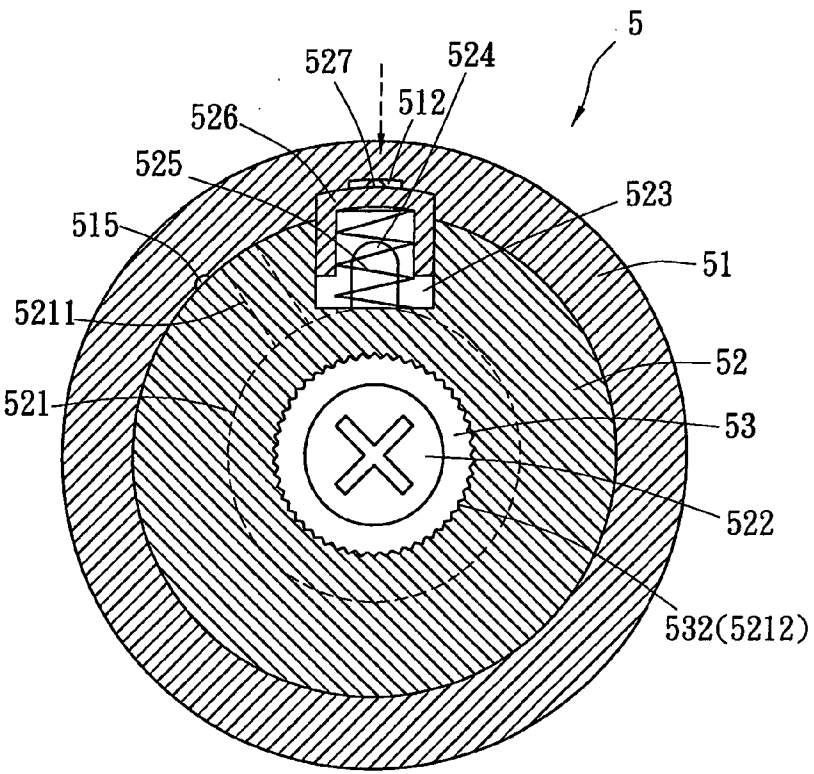
FIG. 3A is a cross-sectional view at Position 3A—3A of FIG. 2.
Figure 4:
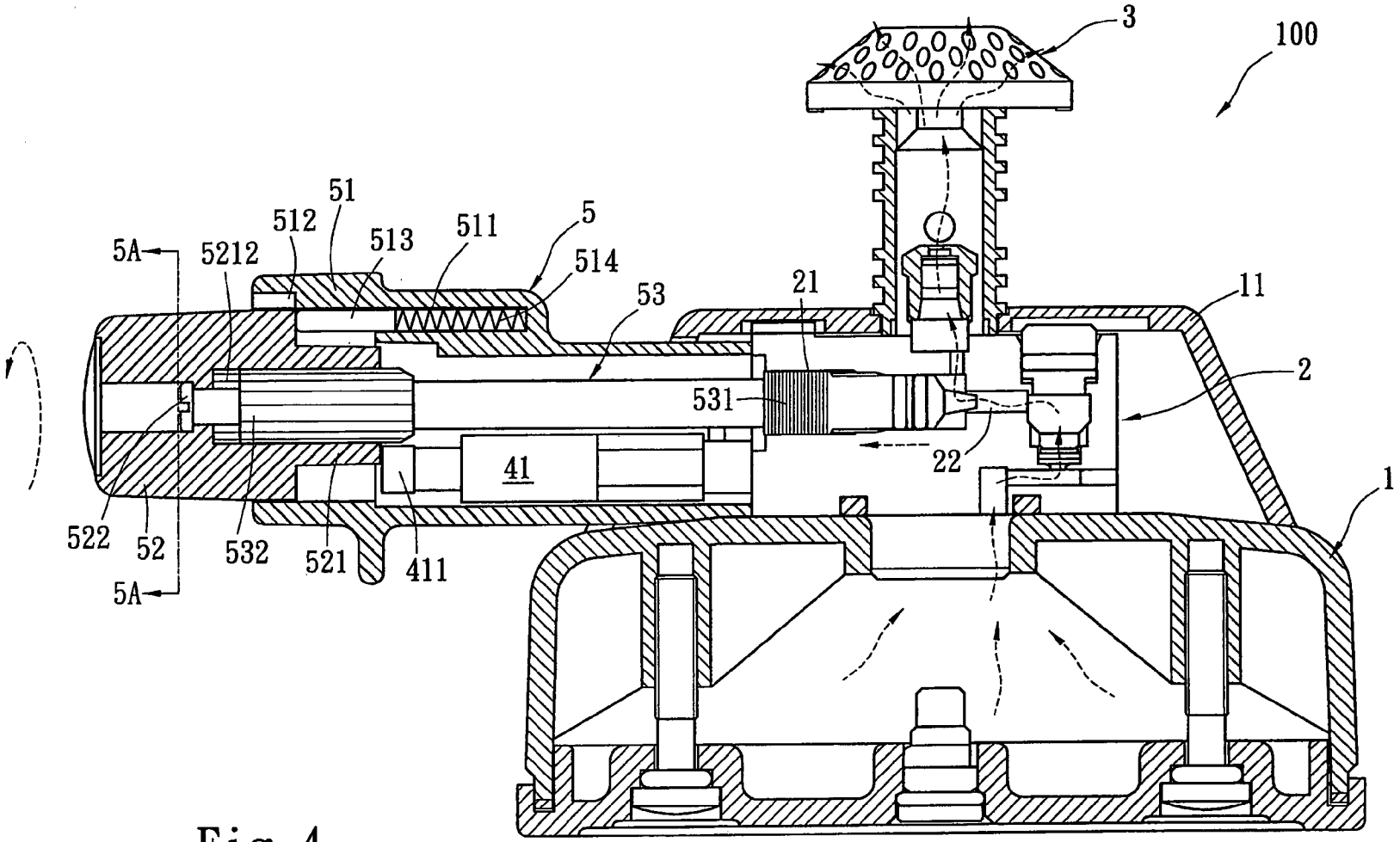
FIG. 4 is a cross-sectional view of the heat control device installed in the gas stove of a preferred embodiment of this invention.

Please refer to FIGS. 3A, 3B, and 4 respectively for the cross-sectional view of Position 3A—3A of FIG. 2, the diagram showing the movement as depicted in FIG. 3A, and the cross-sectional view of a preferred embodiment of the present invention being installed in a gas stove. In the figures, the pressing member 526 pressed into the limit notch 512 of button base 51 is usually pressed into the accommodating groove 523 on the push-switch 52 (as shown in FIG. 3A), and the push-switch 52 is rotated counterclockwise, such that when the adjusting rod 53 is rotated out from the adjusting hole 22 (as shown in FIG. 4), the guide passage 22 of the nozzle base 2 allows the gas flow, and the gas can be discharged through the passage along the storage base 1, nozzle base 2, and nozzle 3.

Figure 5B:
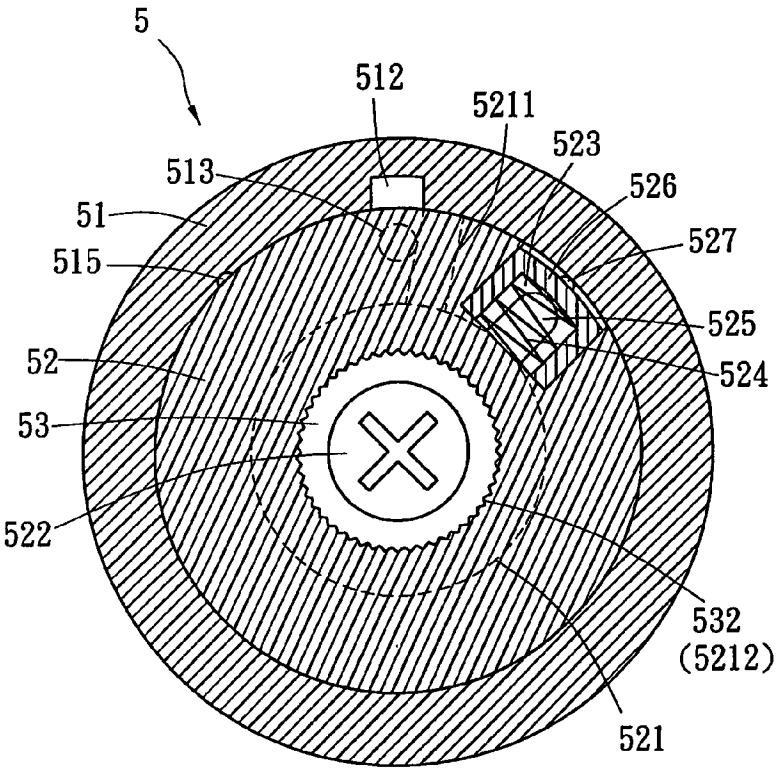
FIG. 5B is a diagram of movements according to FIG. 5A.
Figure 5A:
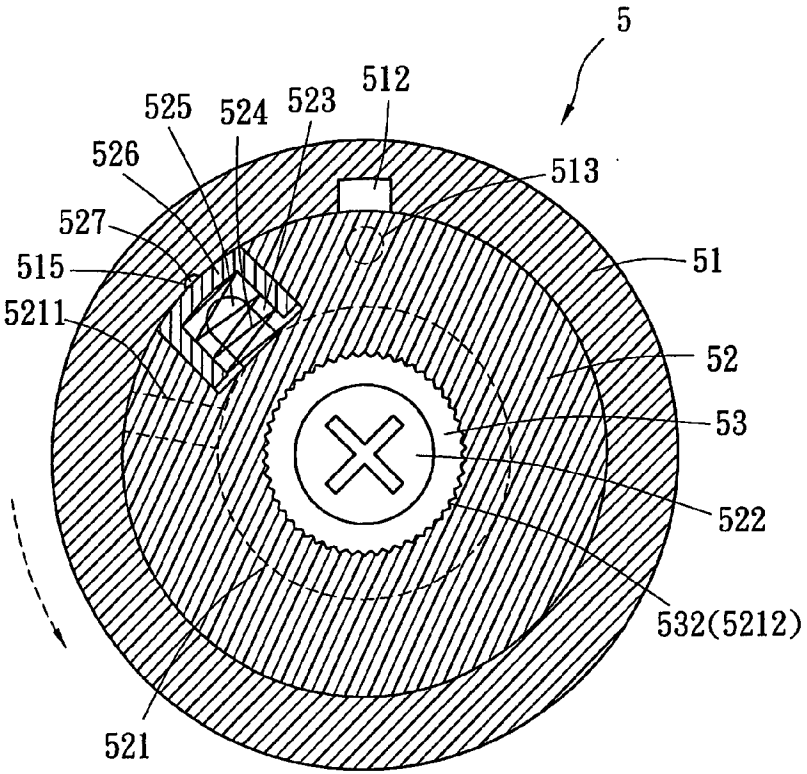
FIG. 5A is a cross-sectional view at Position 5A—5A of FIG. 4.
Figure 6:
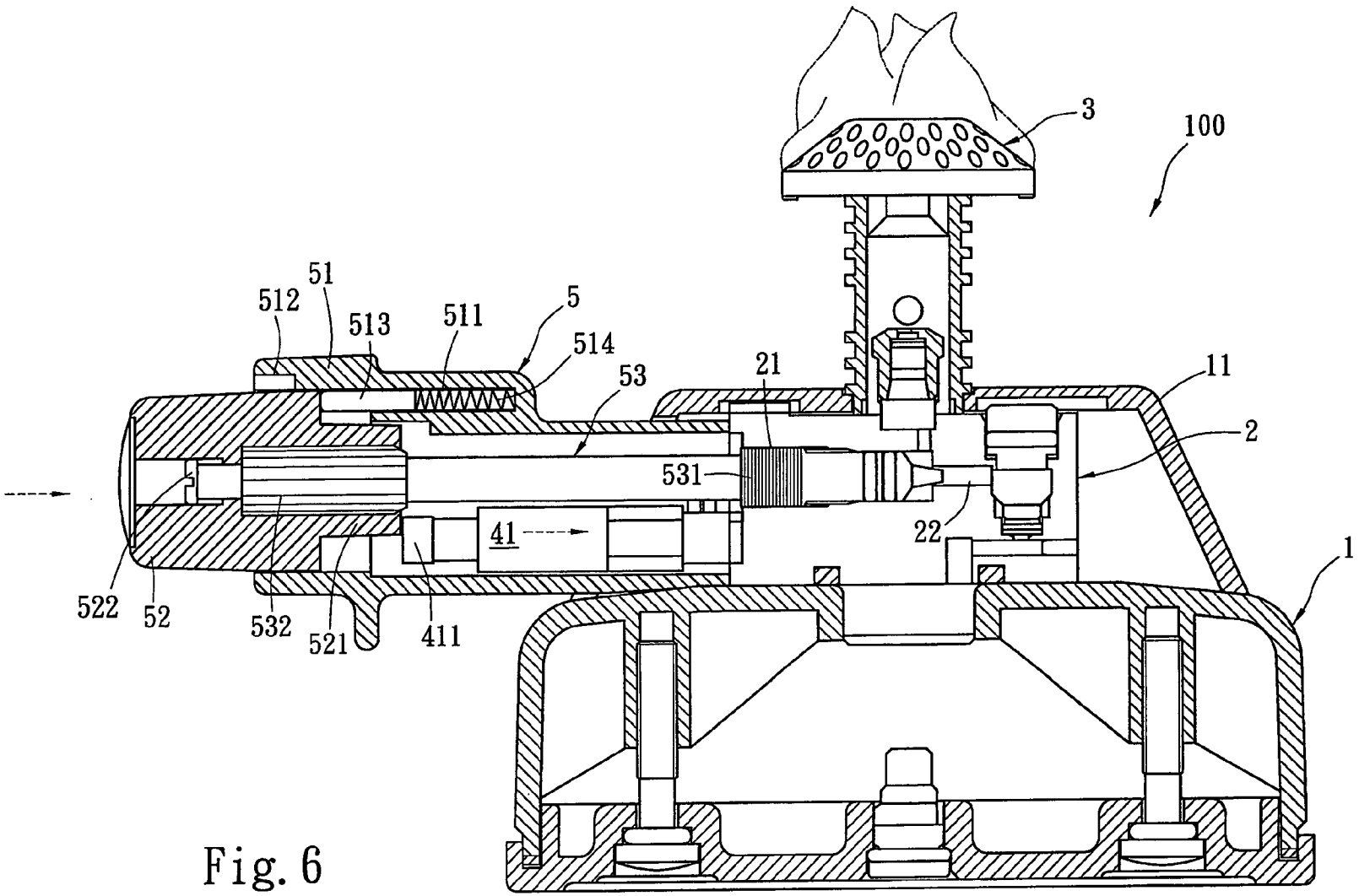
FIG. 6 is a cross-sectional view of the heat control device installed in the gas stove of a preferred embodiment of this invention.

Please refer to FIGS. 5A, 5B, and 6 respectively for the cross-sectional view of Position 5A—5A of FIG. 4, the diagram showing the movements as depicted in FIG. 5A, and the cross-sectional view of another preferred embodiment of this invention being installed inside the gas. In the figures, a recession 515 is disposed in the inner wall of the aforementioned button base 51 for accommodating a limit section 527 protruded from the top of the pressing member 526 of the push-switch 52. Thus, when a user rotates the push-switch 52 counterclockwise, the limit section 527 is precisely accommodated into the recession 515 (as shown in FIG. 5A) and the gas flow can meet the ignition requirement. Then the user can press the push-switch 52 to slide the external screw thread 532 at one end of the adjusting rod 53 corresponsive to the internal thread 5212 inside the cylindrical hollow button base 51, such that the support section 521 at the end of the push-switch 52 slides along the direction from the inside of the button base 51 towards the igniter 41 (as shown in FIG. 6) to further press the pressing section 411 at one end of the igniter, and instantaneously produce an electric discharge and a spark at the electrode 42 on the other end of the electronic ignition device. The spark ignites a flame at the top of the nozzle 3 when the gas supply is turned on.

If the user presses the push-switch 52 to ignite a flame at the nozzle 3 and then rotates the push-switch 52, the flame size at the nozzle 3 increases as the adjusting rod 53 is adjusted to increase the gas flow in the guide passage 22. If the push-switch 52 is rotated counterclockwise until the displacement of the blocking member 5211 of the support section 521 of the push-switch 52 is blocked and restricted by the pressing axle 513 of the installing notch 511 to give a maximum gas supply or the strongest flame at the nozzle 3.

Please refer to FIG. 2 for the cross-sectional view of the present invention being installed in the gas stove 100. In the figure, the shutdown operation of the gas stove 100 only requires the user to turn the push-switch 52 clockwise, and the adjusting rod 53 will rotate clockwise to adjust the guide passage 22 and reduce the gas supply, or extinguish the flame at the nozzle 3 by setting the guide passage 22 to a state of not allowing any gas supply. Finally, the pressing member 526 on the push-switch 52 is latched into the limit notch 512, such that a force from the spring 525 below is exerted on the pressing member 526 to instantaneously press the pressing member 526 into the limit notch 512 of the button base 51 and restrict the rotation or the pressing operation of the push-switch 52, and thus the guide passage 22 in the nozzle base 2 does not allow any gas supply to ensure the complete shutdown of the gas stove 100 and prevent gas leakage.

When the gas stove 100 is completely shut, the push-switch 52 is latched into the limit notch 512 by the pressing member 526 to prevent it from rotating and sliding. The push-switch 52 is unable to rotate and also unable to press the igniter 41 for ignition, and thus effectively preventing an electric charge and a spark instantaneously produced at the electric discharge end at the other end of the electrode by pressing the push-switch 52 by accident. Such arrangement is not safe at all.

Please refer to FIG. 1 again for the perspective view of the disassembled parts of the switch assembly of this invention. In the figure, a hood 11 is disposed around the nozzle base 2 of the portable gas stove 100 for the protection.

In summation of the description above, the design of the heat control device 5 of this invention completely latches the pressing member 526 of the push-switch 52 into the limit notch 512 to ensure a complete shutdown of the gas stove 100 and effectively prevent any gas leakage caused by the user's careless operation of not turning off the control button completely.

Further, the limit section 527 is accommodated precisely inside the recession 515 to set the gas flow to meet the ignition requirement and effectively ignite the gas stove. Such arrangement can avoid wasting the time of adjusting the gas supply by the user's experience or trial and error.

What is claimed is:

1. A heat control device of a portable gas stove having a storage base, a nozzle base disposed on said storage base, a nozzle and an electronic ignition device disposed on said nozzle base, and a heat control device disposed on one side of said nozzle base, and said heat control device comprising:

a hollow cylindrical button base, having one end coupled to said nozzle base, an installing slot protruded from the top of the inner wall of said button base, a spring disposed in the installing slot, a pressing axle for pressing against the outer end of said spring, and a limit notch disposed in the installing slot at a position corresponding to the open end of said button base;

a push-switch, disposed on the other end of said nozzle base, an adjusting rod installed between said push-switch and nozzle base, an installing slot disposed on said push-switch, a spring installed in said installing slot, a pressing member disposed on said installing slot, and the rear end of said pressing member being engaged in said limit notch at the open end of said button base, and a support section protruded from one end extending from said button towards said button base;

thereby the pressing member of said push-switch being completely latched inside said limit notch to ensure a complete shutdown of gas supply to the gas stove.

2. The heat control device of a portable gas stove of claim 1, wherein said installing slot comprises a fixed axle for sheathing a spring.

3. The heat control device of a portable gas stove of claim 1, wherein said pressing member at its top comprises a limit section.

4. The heat control device of a portable gas stove of claim 1, wherein said support section comprises a blocking member.

5. The heat control device of a portable gas stove of claim 1, wherein said button base comprises a recession on its inner wall.

6. The heat control device of a portable gas stove of claim 1, wherein said adjusting rod has another end being extended from said button base and coupled to said switch button by a locking member.

7. The heat control device of a portable gas stove of claim 1, wherein said gas stove has a hood disposed around the periphery of said nozzle base.

* * * * *